US012618180B2

(12) United States Patent
Xu et al.

(10) Patent No.: US 12,618,180 B2
(45) Date of Patent: May 5, 2026

(54) MANUFACTURING METHOD FOR LIGHT-COLORED FULL-SHADING CURTAIN CLOTH, AND LIGHT-COLORED FULL-SHADING CURTAIN CLOTH

(71) Applicant: Guangzhou Hande New Materials Co., Ltd, Guangzhou (CN)

(72) Inventors: Zhenghui Xu, Guangzhou (CN); Ding Zheng, Guangzhou (CN); Hao Qian, Guangzhou (CN)

(73) Assignee: Guangzhou Hande New Materials Co., Ltd, Guangzhou (CN)

( * ) Notice: Subject to any disclaimer, the term of this patent is extended or adjusted under 35 U.S.C. 154(b) by 358 days.

(21) Appl. No.: 18/346,256

(22) Filed: Jul. 2, 2023

(65) Prior Publication Data

US 2025/0003128 A1 Jan. 2, 2025

(51) Int. Cl.

| | |
|---|---|
| ***D06C 27/00*** | (2006.01) |
| ***D03D 1/00*** | (2006.01) |
| ***D03J 1/06*** | (2006.01) |

(52) U.S. Cl.

CPC ..... *D06C 27/00* (2013.01); *D03D 1/0017* (2013.01); *D03J 1/06* (2013.01); *D10B 2503/02* (2013.01)

(58) Field of Classification Search

CPC ..... B32B 37/0076; B32B 1292/30; B32B 38/0004; B32B 38/16; B32B 38/164; Y10T 156/1062; D03D 1/0017; D03D 15/217; D03D 15/283; D10B 2201/02; D10B 2201/04; D10B 2201/10; D10B 2321/101; D10B 2331/04; D10B 2503/02; D03J 1/06; D06C 27/00

USPC ..... 156/280, 281, 291, 292

See application file for complete search history.

(56) References Cited

U.S. PATENT DOCUMENTS

2025/0003128 A1* 1/2025 Xu ..... D06C 27/00

FOREIGN PATENT DOCUMENTS

| | | |
|---|---|---|
| CN | 102433645 A | 5/2012 |
| CN | 112267192 A | 1/2021 |
| CN | 216231073 U | 4/2022 |

* cited by examiner

*Primary Examiner* — Sonya M Sengupta
(74) *Attorney, Agent, or Firm* — Nitin Kaushik

(57) ABSTRACT

The present application discloses a manufacturing method for a light-colored full-shading curtain cloth, and a light-colored full-shading curtain cloth, and relates to the technical field of curtain cloths. The manufacturing method comprises the following steps: manufacturing a greige cloth; the manufacturing of a curtain cloth outer layer, a curtain cloth inner layer, and a shading layer; the cleaning of the cloth material; the drying and rolling of cloth material; the transfer and secondary drying of the cloth material; the bonding between a plurality of layers of the cloth material; rolling; and painting a coating layer on the outer side of the curtain cloth outer layer. In the manufacturing process of the light-colored full-shading curtain cloth, the drying mode of the curtain cloth is optimized; through the secondary drying treatment, the inner layer and outer layer of the curtain cloth are subjected to secondary drying.

14 Claims, 12 Drawing Sheets

MANUFACTURING METHOD FOR LIGHT-COLORED FULL-SHADING CURTAIN CLOTH, AND LIGHT-COLORED FULL-SHADING CURTAIN CLOTH

TECHNICAL FIELD

The present application relates to the technical field of curtain cloths, and specifically to a manufacturing method for a light-colored full-shading curtain cloth, and a light-colored full-shading curtain cloth.

BACKGROUND

The main function of a curtain is to separate a room from the outside to maintain the privacy of a living room, and a curtain has the functions of shading and heat insulation and adjusting the light inside the room. The curtain is also an indispensable ornament for home decoration. Modern curtains can not only reduce light and shade light, and adapt to people's requirements of different light intensity, but also can prevent wind, remove dust, keep warmth, eliminate sounds, insulate the heat, perform radiation protection, perform ultraviolet protection, etc. so as to improve the climate and environment of the living room.

As the name suggests, a full-shading curtain is a full-shading curtain with a 99.99% shading degree. A coating curtain of an interlayer curtain is the common full-shading curtain on the market. The interlayer curtain is that one layer of black silk cloth is wrapped between two sides of the curtain cloth in the front and the rear to achieve the shading effect through the black silk cloth. The coating curtain is a kind of curtain with good shading performance, which mainly makes a coating layer with a shading effect behind the curtain cloth to effectively isolate light through the coating layer and finally achieve the purpose of shading.

At present, when coating curtains are processed, the curtains need to be cleaned and dried in sequence; however, since the curtains occupy a large area after being unfolded, the drying treatment is generally to fold and stack the curtains for drying. In order to ensure processing efficiency, it is generally to dry the curtains for a certain period of time and then perform the subsequent coating and bonding processing procedures. However, in the previous drying process, a case exists that partial areas are stacked to result in incomplete drying, so that partial areas of the curtain have more water content during the subsequent coating and gluing bonding, which affects the coating and bonding effects.

Therefore, how to quickly and effectively dry the cleaned curtain becomes an urgent problem to be solved.

SUMMARY

The object of the present application is to provide a manufacturing method for a light-colored full-shading curtain cloth, and a light-colored full-shading curtain cloth for solving the above problem that a part of the areas is stacked so as to cause ineffective drying mentioned in the background art.

In order to achieve the above-mentioned object, the present application provides the following technical solutions: a manufacturing method for a light-colored full-shading curtain cloth, comprising the steps:

manufacturing a greige cloth, performing weaving by a weaving machine, and simultaneously weaving a shading material into a greige cloth of a shading layer by the weaving machine;

manufacturing a curtain cloth outer layer, a curtain cloth inner layer, and a shading layer, cutting the greige cloth of an inner layer and an outer layer of the curtain cloth to obtain the curtain cloth outer layer and the curtain cloth inner layer of a preset size, and cutting the greige cloth of the shading layer to obtain the shading layer of the preset size;

cleaning a cloth material, and placing the curtain cloth outer layer, the curtain cloth inner layer, and the shading layer into the water for immersion cleaning for removing impurities attached on an outer side;

drying and rolling the cloth material, respectively placing the cleaned curtain cloth outer layer, curtain cloth inner layer, and shading layer into a drying device for drying, and respectively rolling the dried curtain cloth outer layer, curtain cloth inner layer, and shading layer;

transferring and secondary drying the cloth material, performing contacting transfer on the curtain cloth outer layer and the curtain cloth inner layer by using a pre-mounted turning component, and performing secondary drying on the curtain cloth outer layer and the curtain cloth inner layer by using a secondary drying mechanism built in the turning component;

a bonding between a plurality layers of cloth materials, applying glue to a gap at an outer edge of the curtain cloth outer layer and the curtain cloth inner layer for bonding the curtain cloth outer layer, the curtain cloth inner layer, and a middle shading layer;

rolling, performing rolling on the curtain cloth outer layer, the shading layer, and the curtain cloth inner layer bonded together; and painting, painting a coating layer on the outer side of the curtain cloth outer layer.

The present application further provides a light-colored full-shading curtain cloth, comprising:

a curtain cloth outer layer, a curtain cloth inner layer, and a shading layer, wherein cloth material base layers of the curtain cloth outer layer and the curtain cloth inner layer are formed by co-weaving cotton linen fibers and bamboo charcoal fibers, and the shading layer is formed by co-weaving polyester fibers, acrylic fibers, and graphene fibers;

the shading layer is located between the curtain cloth outer layer and the curtain cloth inner layer, widths of the curtain cloth outer layer and the curtain cloth inner layer are consistent, and the width of the shading layer is less than the widths of the curtain cloth outer layer and the curtain cloth inner layer;

the outer side of the curtain cloth outer layer is provided with a coating layer, and the outer edges of the curtain cloth outer layer and the curtain cloth inner layer are bonded to the shading layer.

Compared with the prior art, the beneficial effects of the present application are as follows:

in the manufacturing process of a light-colored full-shading curtain cloth in the present application, the mode of drying the same is optimized; the secondary drying treatment for the shading layer is realized through the secondary drying mechanism; in cooperation, dry air is inflated to the inside of the turning component and the turning roll, and the secondary drying for the inner layer and outer layer of the curtain cloth is realized through the cooperation between the occluding assembly and the adjustment member; through the secondary drying, it can enable some areas of the cloth material that are not thoroughly dried to be thoroughly dried during stacking and drying, thereby improving the drying effect.

Figure 1:
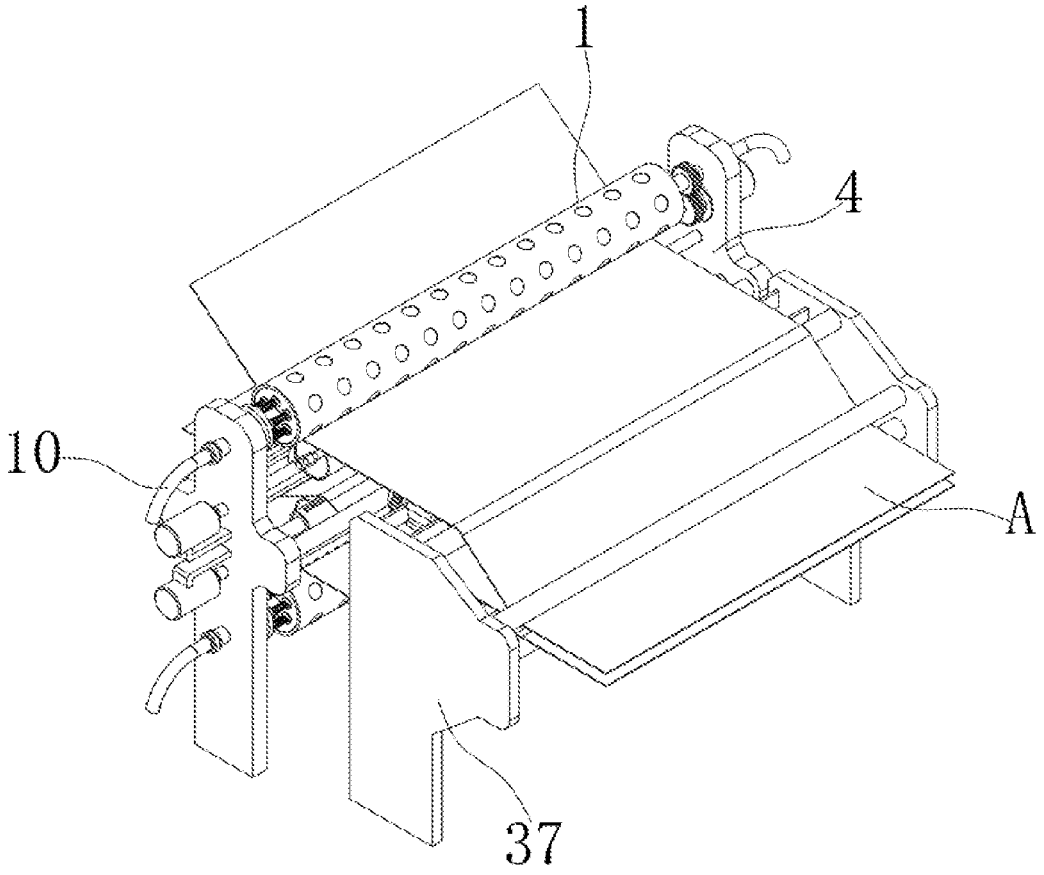
FIG. 1 is a schematic diagram of an overall structure of the present application.

In the drawings: A—curtain cloth outer layer; B—curtain cloth inner layer; C—shading layer; D—coating layer; 1—turning component; 2—secondary drying mechanism; 3—turning roll; 4—side plate; 5—connecting pipe; 6—air blowing opening; 7—occluding assembly; 8—drive member; 9—adjustment member; 10—air transferring pipe; 11—adjustment lever; 12—occluding protrusion; 13—adjustment seat; 14—adjustment opening; 15—adjustment inclined block; 16—slide bar; 17—hemispherical block; 18—adjustment disk; 19—arc-shaped protrusion; 20—extrusion spring; 21—grommet; 22—drive motor; 23—drive gear; 24—transmission gear; 25—drive rod; 26—docking frame; 27—rotational motor; 28—cylinder; 29—air suction pipe; 30—air suction hole; 31—exhaust pipe; 32—exhaust fan; 33—mounting pipe; 34—exhaust port; 35—heating strip; 36—contact roll; 37—support plate; 38—guide post; 39—distraction piece; 40—fixing plate; 41—rotating shaft; 42—rotational gear; 43—toothed belt; 44—distraction motor; 45—contact column; 46—inclined plate; 47—driven gear; 48—driving gear; 49—distraction wheel; and 50—connecting column.

DETAILED DESCRIPTION OF THE EMBODIMENTS

The following is a further description of the present application in conjunction with specific embodiments. The illustrative embodiments and explanations of the present disclosure are used to explain the present application, but are not intended to limit the present application.

Embodiment 1

Figure 2:
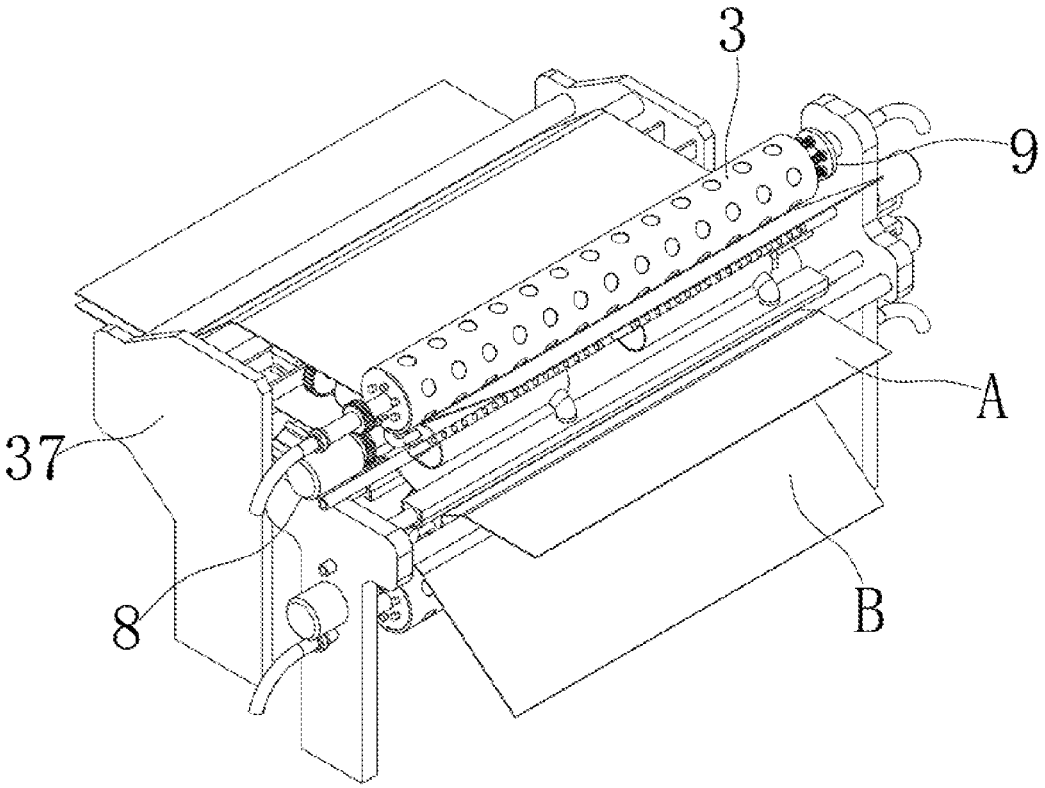
FIG. 2 is a schematic diagram of the partial cross-sectional structure of a side plate from another angle of the entirety of the present application.
Figure 3:
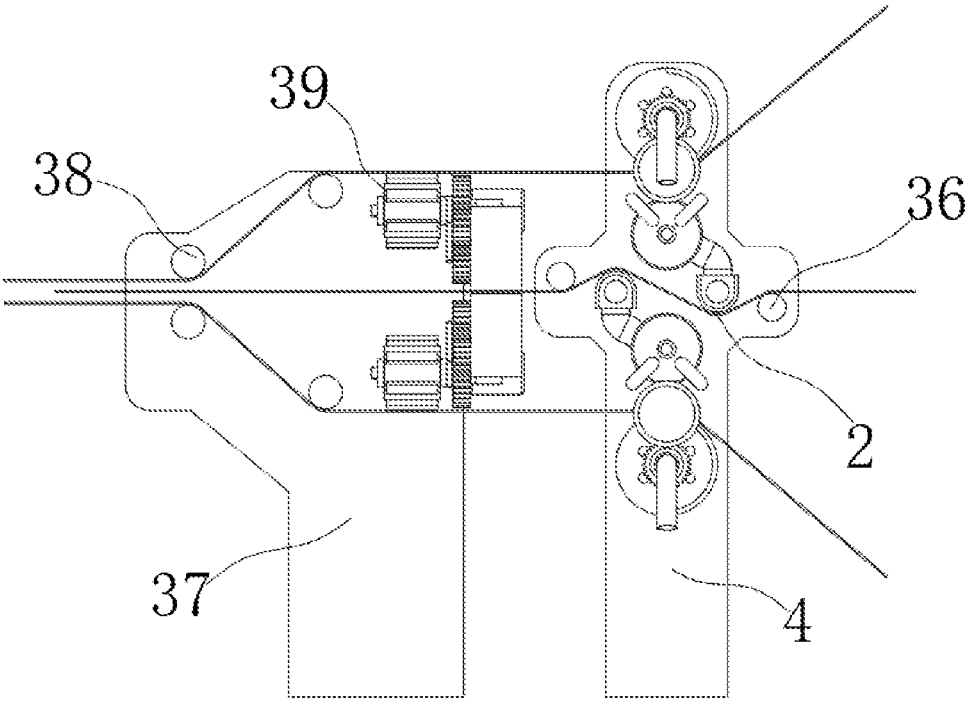
FIG. 3 is a side view of the present application with one side plate removed.

Referring to FIGS. 2 and 3, a manufacturing method for a light-colored full-shading curtain cloth includes the steps;

S01, manufacturing a greige cloth, performing weaving by a weaving machine, and simultaneously weaving a shading material into a greige cloth of a shading layer C by the weaving machine;

S02, the manufacturing of a curtain cloth outer layer A, a curtain cloth inner layer B, and a shading layer C, cutting the greige cloth of the inner layer and outer layer of the curtain cloth to obtain a curtain cloth outer layer A and a curtain cloth inner layer B of a preset size, and cutting the greige cloth of the shading layer C to obtain a shading layer C of the preset size;

S03, cleaning the cloth material, and placing the curtain cloth outer layer A, the curtain cloth inner layer B, and the shading layer C of the preset size into water for immersion cleaning for removing impurities attached on the outer side;

S04, drying and rolling the cloth material, respectively placing the cleaned curtain cloth outer layer A, curtain cloth inner layer B, and shading layer C into a drying device for drying, and respectively rolling the dried curtain cloth outer layer A, curtain cloth inner layer B, and shading layer C;

S05, the transfer and the secondary drying of the cloth material, performing contacting transfer on the curtain cloth outer layer A and the curtain cloth inner layer B by using the pre-mounted turning component 1, and performing the secondary drying treatment on the curtain cloth outer layer A and the curtain cloth inner layer B by using the secondary drying mechanism 2 built in the turning component;

S06, the bonding between a plurality layers of cloth materials, applying glue to the gap at the outer edge of the curtain cloth outer layer A and the curtain cloth inner layer B for bonding the curtain cloth outer layer A, the curtain cloth inner layer B, and the shading layer C;

S07, rolling, performing rolling on the curtain cloth outer layer A, the curtain cloth inner layer B, and the shading layer C bonded together; and S08, painting, painting the coating layer D on the outer side of the curtain cloth outer layer.

In this solution, the greige cloth of the curtain cloth is manufactured first, and then the greige cloth can be cut into a suitable size to meet the size of the curtain required, and then the same is cleaned and dried, and then the three-layer fabric of the curtain cloth outer layer A, the curtain cloth inner layer B, and the shading layer C is subjected to a bonding operation; during the bonding, since there would be a situation where the local fabric would be dried thoroughly, this situation would affect the subsequent application of the coating layer D, and the inner layer and outer layer of the curtain cloth and the outer side of the shading layer C are transferred and simultaneously subjected to the secondary drying operation by means of the designed secondary drying mechanism 2 cooperating with the turning component 1, thereby avoiding partial undried curtain cloth outer layer A, curtain cloth inner layer B, and shading layer C.

At the same time, with reference to FIGS. 1-5, the illustration comprises a turning component 1 and a secondary drying mechanism 2 in step S05; the turning component 1 comprises two turning rolls 3 and two side plates 4; the two turning rolls 3 are of a hollow pipe structure and are respectively in contact with the curtain cloth outer layer A and the curtain cloth inner layer B; two ends of the two turning rolls 3 are fixedly in communication with a connecting pipe 5, and the connecting pipe 5 is rotatably connected to the side plate 4; a plurality of rows of air blowing openings 6 is provided at equal angles on the outer side of the turning roll 3, and an occluding assembly 7 is correspondingly mounted in each row of air blowing openings 6; one of the side plates 4 is mounted with a drive member 8 for rotating the turning roll 3, and the other side plate 4 is mounted with an adjustment member 9 for adjusting the form of the occluding assembly 7; the outer end of the connecting pipe 5 is rotatably butted with an air transferring pipe 10 for inflating dry hot air, and the secondary drying mechanism 2 is mounted between the two side plates 4.

It needs to be noted that the air transferring pipe 10 is butted with an external inflation device, and dry hot air is introduced into the turning roll 3 through the air transferring pipe 10. The turning roll 3 is a hollow pipe, and the air blowing opening 6 on the turning roll 3 is blocked by the occluding assembly 7. The injection of dry hot air from the outside will cause high pressure inside the turning roll 3. Then, one row of occluding assemblies 7 is opened through the adjustment member 9, so that one row of air blowing openings 6 that come into contact with the curtain cloth outer layer A and the curtain cloth inner layer B can blow air hot air, thereby performing secondary drying on the curtain cloth outer layer A and the curtain cloth inner layer B.

It further needs to be noted that through the action of the drive member 8, a plurality of rows of occluding assemblies 7 is driven to successively contact with the adjustment member 9), and the air blowing openings 6 are successively opened, so as to meet the rotation of the turning roll 3, and at the same time, ensure that each time the air can be blown towards the curtain cloth outer layer A and the curtain cloth inner layer B for drying.

Figure 6:
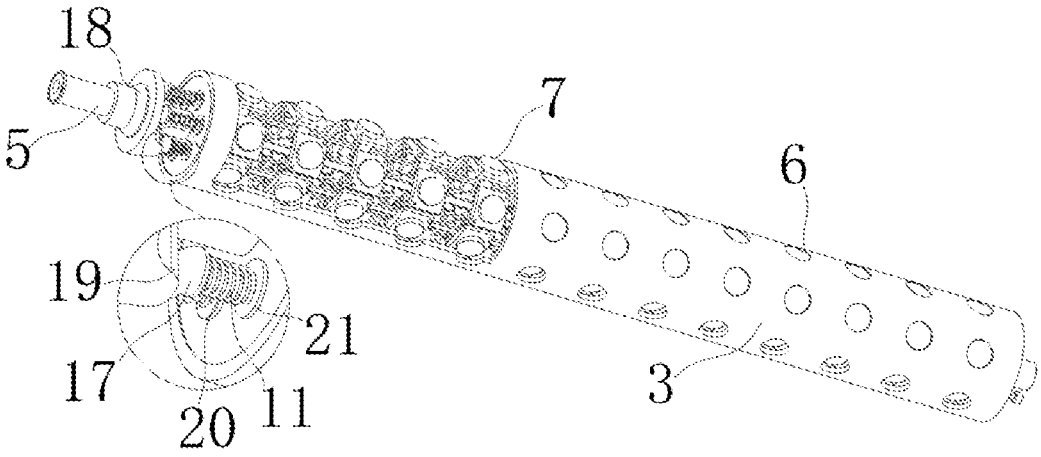
FIG. 6 is a schematic diagram of an internal structure of a turning roll in the present application after the partial section.
Figure 7:
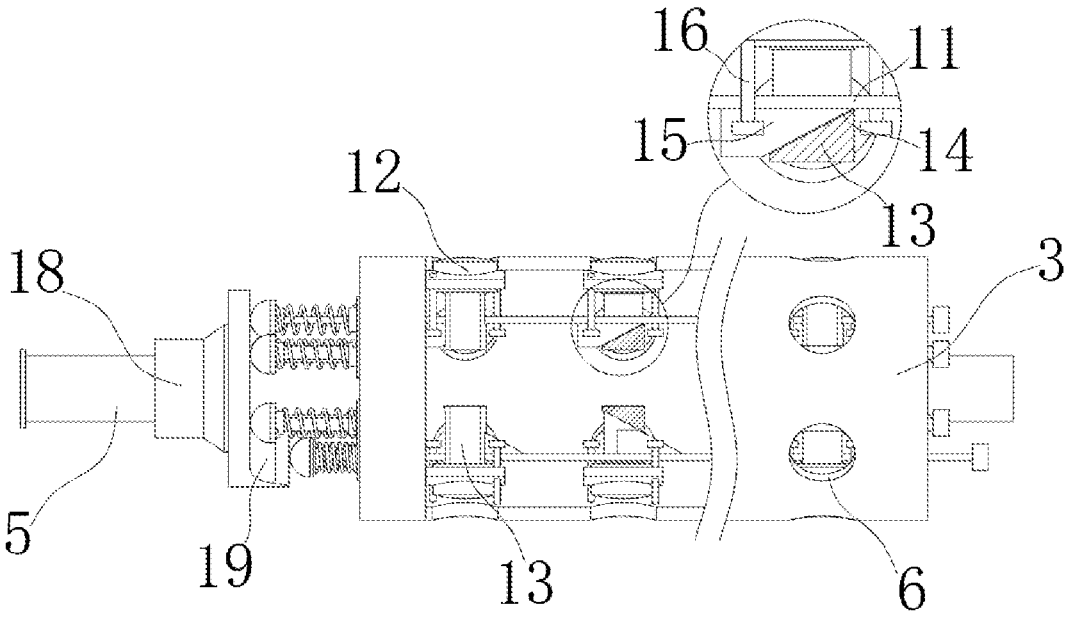
FIG. 7 is a schematic structural diagram of part of an occluding assembly in the present application.

With reference to FIGS. 6 and 7, the occluding assembly 7 in the figure comprises an adjustment lever 11 and a plurality of occluding protrusions 12. The top air blowing openings 6 of the occluding protrusions 12 are inserted into each other, an adjustment seat 13 is fixed at the bottom, an adjustment opening 14 is opened in the adjustment seat 13, and the cross-sectional shape of the adjustment opening 14 is a right-angled trapezoid. Two ends of the adjustment lever 11 slide through two ends of the turning roll 3 and are inserted into the adjustment openings 14 in one row of the adjustment seats 13, an adjustment inclined block 15 adapted to the bevel end of the adjustment opening 14 is fixed on the outer side of the adjustment lever 11, and a slide bar 16 fixed to the inner wall of the turning roll 3 is fixed on the outer side of the occluding protrusions 12.

Figure 5:
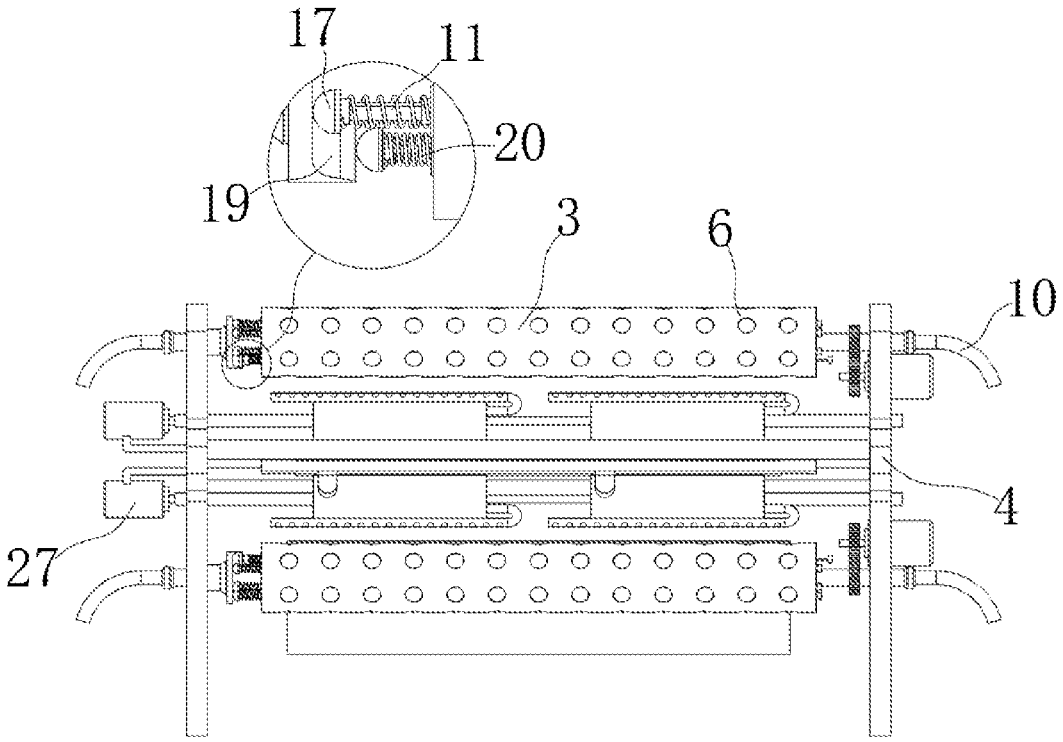
FIG. 5 is a front view of a turning roll and a secondary drying mechanism of the present application.

Meanwhile, referring to FIGS. 5-7, the adjustment member 9 shown in the figures comprises a hemispherical block 17 fixed at the outer ends of the plurality of adjustment levers 11 and an adjustment disk 18 fixed at the outer side of one of the side plates 4. The adjustment disk 18 is rotatably sleeved with one of the connecting pipes 5, an arc-shaped protrusion 19 is fixed at the bottom of one side of the adjustment disk 18 near the turning roll 3, the arc-shaped protrusion 19 is fitted with the hemispherical block 17, and the outer sides of the plurality of adjustment levers 11 are all sleeved with an extrusion spring 20 abutting against the hemispherical block 17 and the outer wall of the turning roll 3.

Figure 4:
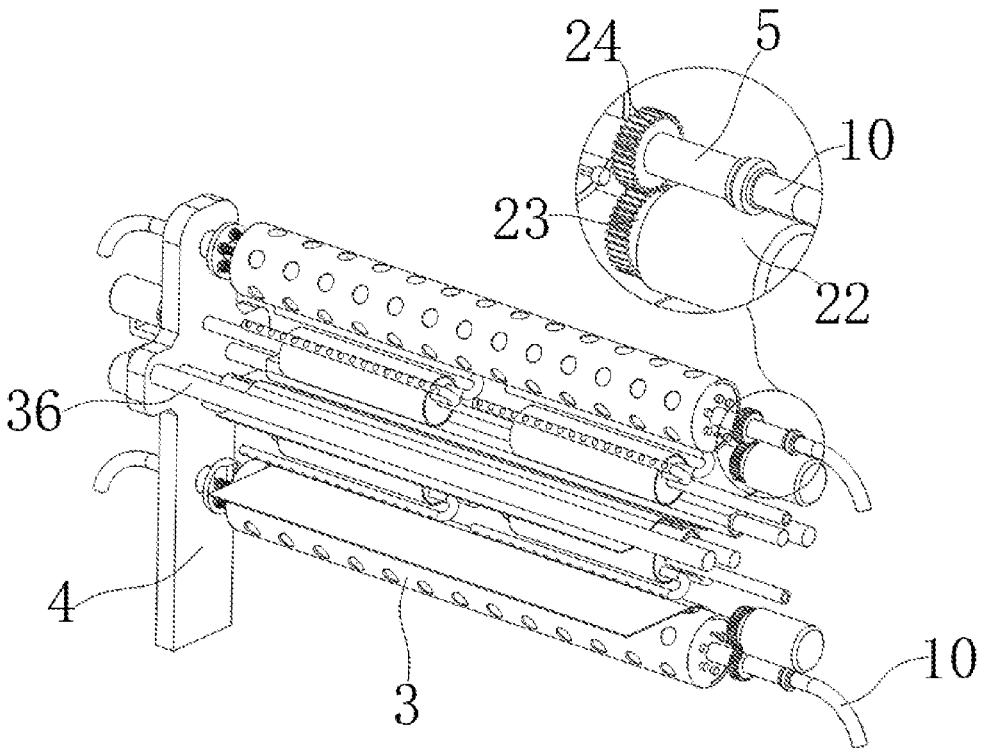
FIG. 4 is a schematic diagram showing the positional relationship between a turning roll and a secondary drying mechanism according to the present application.

Meanwhile, referring to FIG. 4, the illustrated drive member 8 includes a drive motor 22 fixed to the side plate 4. The output end of the drive motor 22 is fixed with a drive gear 23, and the outer side of the connecting pipe 5 is fixed with a transmission gear 24 that meshes with the drive gear 23.

The principle of adjusting the form of the occluding assembly 7 by means of the adjustment member 9 is as follows: firstly, the drive motor 22 rotates, driving the drive gear 23 to follow the rotation, and causing the meshing transmission gear 24 to rotate, thus driving the connecting pipe 5 and the turning roll 3 to rotate, thereby, through the turning roll 3, enabling the inner layer and outer layer of the curtain cloth to turn and move.

Secondly, while the turning roll 3 rotates, a plurality of adjustment levers 11 inside the turning roll 3 will follow the rotation; when the hemispherical block 17 at one end of the adjustment lever 11 contacts with the arc-shaped protrusion 19 at the bottom of the adjustment plate 18, the adjustment lever 11 will be extruded to move towards the inside of the turning roll 3, so that the adjustment inclined block 15 on the outer side of the adjustment lever 11 abuts against the bevel in the adjustment opening 14, and the adjustment inclined block 15 moves with the adjustment lever 11. At that, the adjustment opening 14 can be jacked up, as shown in FIG. 7, thereby driving the corresponding movement of the adjustment seat 13 and the occluding protrusion 12 such that the occluding protrusion 12 is disengaged from the air blowing opening 6. Therefore, the air in the turning roll 3 is disinflated outward through the opened air blowing opening 6, and air blowing can be performed on the inner layer and outer layer of the curtain cloth fitted to the outer side of the turning roll 3. By the dry hot air, the remaining undried area on the inner layer and outer layer of the curtain cloth can be subjected to the secondary drying treatment.

It is worth noting that when the adjustment lever 11 is disengaged from the arc-shaped protrusion 19, the hemispherical block 17 is always fitted with the outer side wall of the adjustment disk 18 by the action of the extrusion spring 20; at the same time, in order to stabilize the fitting of the extrusion spring 20 with the outer wall of the turning roll 3, a grommet 21 is sheathed on the outer side of the adjustment lever 11 abutting against the extrusion spring 20.

In this solution, with reference to FIGS. 3 to 5, 8 and 9, two secondary drying mechanisms 2 are provided in the figure, and the two are distributed on two sides of the shading layer C; the secondary drying mechanism 2 comprises a drive rod 25 and a docking frame 26 in contact with the shading layer C; two ends of the drive rod 25 are rotatably docked with the two side plates 4, and a rotational motor 27 for the rotation of the drive rod 25 is fixed on the outer side of one of the side plates 4; two cylinders 28 are rotatably mounted on the outer side of the drive rod 25, and one end of the two cylinders 28 is fixedly communicated with an air suction pipe 29, and a plurality of air suction holes 30 is provided on the outer side of the air suction pipe 29; an exhaust pipe 31 in communication with the docking frame 26 is fixed to the other end, an exhaust fan 32 for sucking air by the air suction pipe 29 is fixed to the outer wall of the outer-side cylinder 28 where the drive rod 25 is located, and a mounting pipe 33 fixed the side plate 4 is fixed to the outer side of the cylinder 28.

A connecting column 50 fixed to the side plate 4 is fixed to two ends of the docking frame 26, an exhaust port 34 is provided at the bottom of the docking frame 26, a heating strip 35 is fixed in the docking frame 26, two contact rolls 36 are fixed between the two side plates 4, and the two contact rolls 36 are distributed on the outer side of the two docking frames 26 and are in contact with the shading layer C.

The principle of secondary drying the shading layer C is as follows: firstly, the shading layer C passes through between two secondary drying mechanisms 2, as shown in FIG. 3, and then the drive rod 25 is rotated by the rotation of a rotational motor 27 on the outer side, so that the exhaust fan 32 is rotated; at that, the front end of the cylinder 28 performs negative pressure suction, and the rear end performs venting, and the outside air is absorbed via the air suction pipe 29; at the same time, the air is passed into the docking frame 26 via the exhaust pipe 31, the air is dried and heated via the heating strip 35 in the docking frame 26, and then is directly disinflated into the outer side of the shading layer C via the exhaust port 34, and the outer side of the shading layer C is subjected to secondary drying such that undried areas are excluded and the quality of subsequent coating and gluing is improved.

Figure 8:
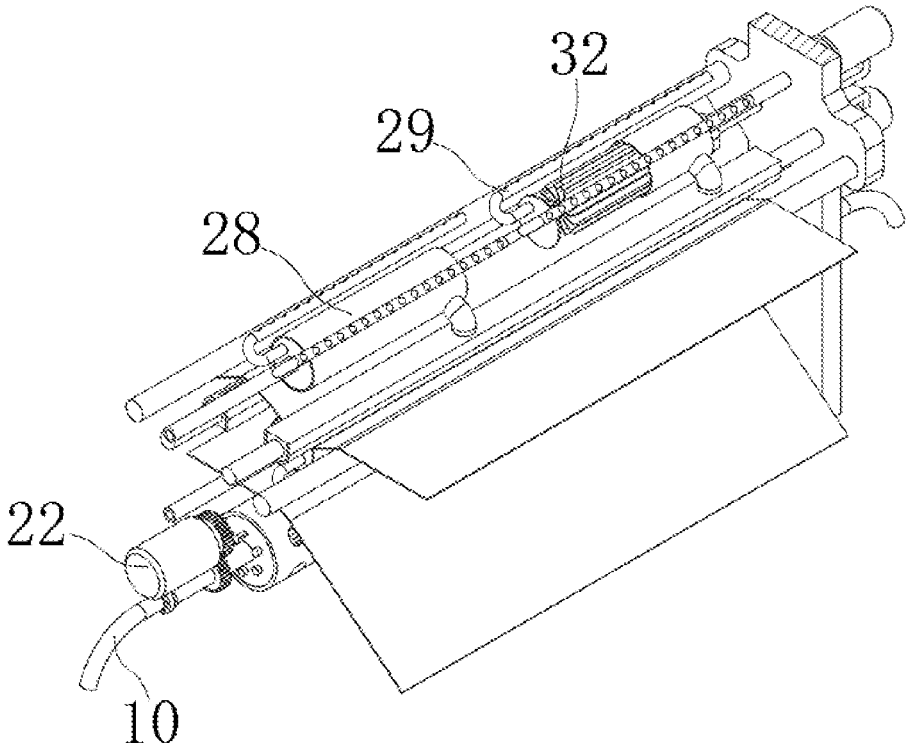
FIG. 8 is a schematic structural diagram of a partial section of an internal cylinder of a secondary drying mechanism of the present application.
Figure 9:
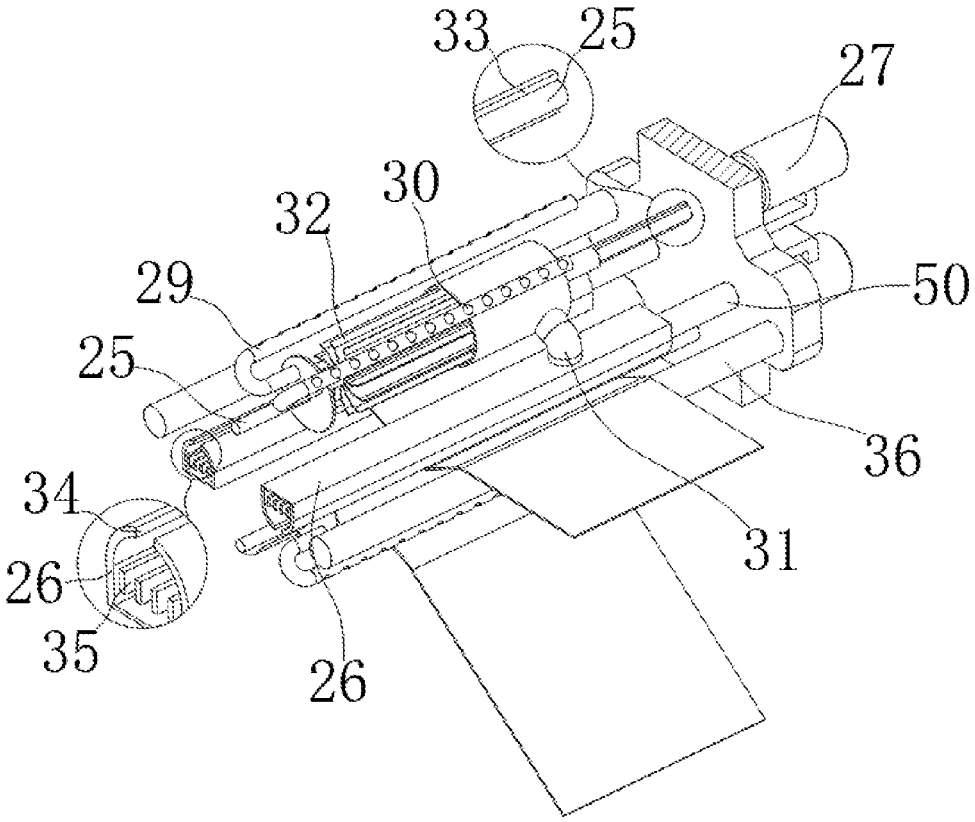
FIG. 9 is a schematic structural diagram of a secondary drying mechanism of the present application after the partial section.

It further needs to be noted that two air suction pipes 29 are provided and are respectively located on the outer side of the turning roll 3; by means of the distribution of the positions of the air suction pipes 29, as shown in FIGS. 3, 4, and 8, both of the two air suction pipes 29 are close to the inner layer and outer layer of the curtain cloth, so as to efficiently absorb the hot air passing through the inner layer and outer layer of the curtain cloth, thereby reducing energy consumption; at the same time, it can also prevent hot air from being disinflated and condensed into water mist when it cools down, which would otherwise blow towards the shading layer C, making it damp and affecting the quality of the subsequent coating and gluing.

A method for performing secondary drying on the inner layer and outer layer of the curtain cloth and the shading layer C is as follows:

- in the first step, the inner layer and outer layer of the curtain cloth and the shading layer C are inserted according to FIGS. 1 and 2, so that the inner layer and outer layer of the curtain cloth are located between two turning rolls 3, and the shading layer C is located between two secondary drying mechanisms 2;
- in the second step, dry air is inflated into the turning roll 3 via an external inflation device, and at the same time, the bottom-most occluding assembly 7 is opened via the adjustment member 9, so as to realize the secondary drying of the inner layer and outer layer of the curtain cloth;
- in the third step, the air permeated from the inner layer and outer layer of the curtain cloth is absorbed by the two secondary drying mechanisms 2, heated and then blown to the shading layer C to achieve secondary drying of the shading layer C.

Figure 12:
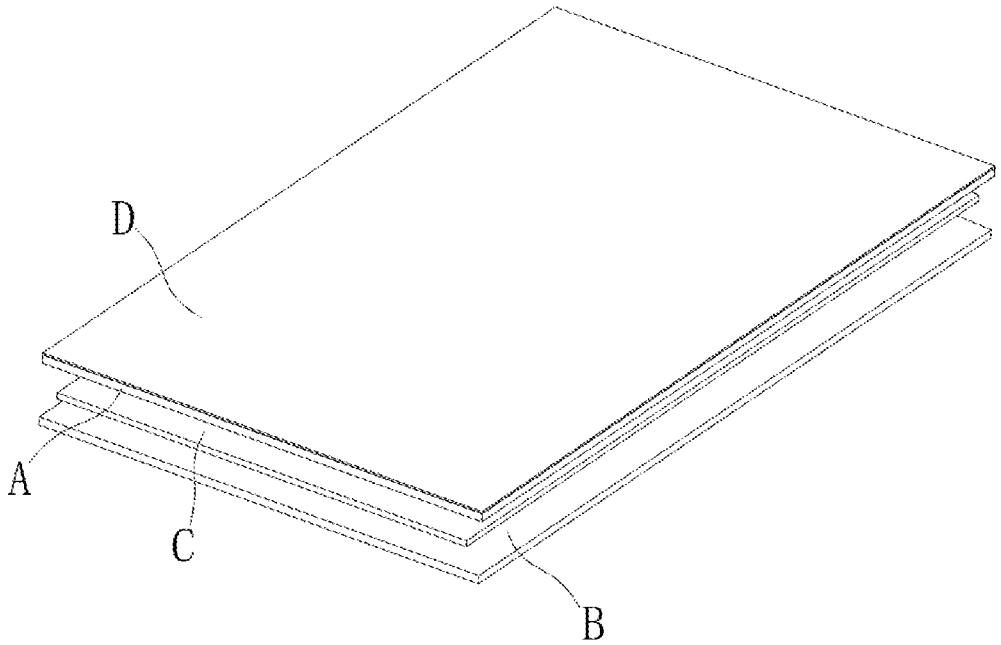
FIG. 12 is a schematic diagram of the layered development of a light-colored full-shading curtain cloth in the present application.

In this solution, with reference to FIG. 12, a light-colored full-shading curtain cloth is shown in the figure, comprising the curtain cloth outer layer A, the curtain cloth inner layer B, and the shading layer C. The cloth base layers of the curtain cloth outer layer A and the curtain cloth inner layer B are formed by co-weaving cotton linen fibers and bamboo charcoal fibers, and the shading layer C is formed by co-weaving polyester fibers, acrylic fibers, and graphene fibers.

The shading layer C is located between the curtain cloth outer layer A and the curtain cloth inner layer B, the widths of the curtain cloth outer layer A and the curtain cloth inner layer B are consistent, and the width of the shading layer C is less than the widths of the curtain cloth outer layer A and the curtain cloth inner layer B.

The outer side of the curtain cloth outer layer A is provided with a coating layer D, and the outer edges of the curtain cloth outer layer A and the curtain cloth inner layer B are bonded to the shading layer C via gluing.

It needs to be noted that in the designed curtain cloth outer layer A, curtain cloth inner layer B, and inner shading layer C, a shading effect is performed through the inner shading layer C. The curtain cloth outer layer A, the curtain cloth inner layer B, and the inner shading layer C are weaved with a light-colored material, and at the same time, a coating layer D is painted on the outer side of the curtain cloth outer layer A, so that it can provide a shading and thermal insulation effect on the curtain cloth outer layer A, thereby enabling the curtain body to achieve shading and thermal insulation functions.

It further needs to be noted that the widths of the curtain cloth outer layer A and the curtain cloth inner layer B are consistent, and the width of the shading layer C is less than the widths of the curtain cloth outer layer A and the curtain cloth inner layer B so that the design mainly satisfies that situation that when the glue is pressed fit, and part of the glue will diffuse outwards due to the extrusion; at this time, it only requires the glue to be smeared on two sides of the shading layer C and then pressing fit is performed, so as to satisfy the pressing fit among the curtain cloth outer layer A, the shading layer C, and the curtain cloth inner layer B, and the glue which is extruded to achieve diffusion overflow is mainly on two sides of the curtain cloth outer layer A and the curtain cloth inner layer B so as to avoid the glue overflowing on the end face.

Embodiment 2

Figure 10:
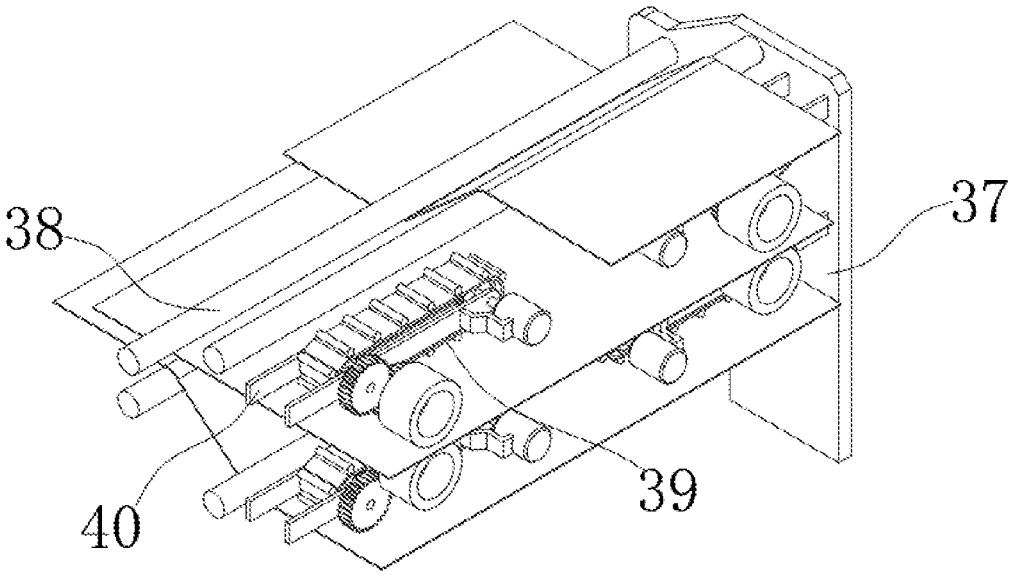
FIG. 10 is a schematic diagram showing the positional relationship between a plurality of distraction pieces and a plurality of guide posts in the present application.
Figure 11:
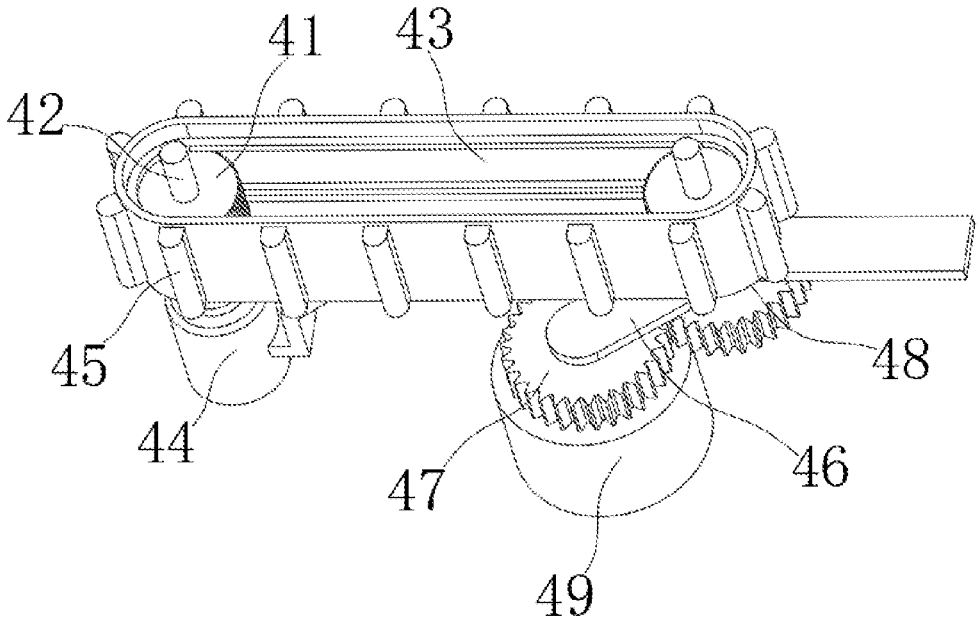
FIG. 11 is a schematic structural diagram of a distraction piece of the present application after removing one fixing plate.

With reference to FIGS. 10 and 11, the implementation mode further explains embodiment 1, two support plates 37 are provided at the front ends of the two side plates 4 in the figure, and two groups of guide posts 38 are fixed between the two support plates 37. The two groups of guide posts 38 are symmetrically distributed on two sides of the shading layer C, and are used for the curtain cloth outer layer A and the curtain cloth inner layer B to be fitted with the shading layer C, and each group of guide posts 38 is composed of two guide posts 38, and the shading layer C is fitted with the outer sides of the two guide posts 38 in sequence.

Four distraction pieces 39 are fixed between the two support plates 37 and symmetrically distributed on two sides of the shading layer C, each distraction piece 39 comprises two fixing plates 40 and two rotating shafts 41 rotatably mounted between the two fixing plates 40, a rotational gear 42 is fixed on the outer side of the two rotating shafts 41, and the outer sides of the two rotational gears 42 are meshed and sleeved with a toothed belt 43; a distraction motor 44 is fixed on the outer side of one of the fixing plates 40, and an output end of the distraction motor 44 is fixed with one end of the rotating shaft 41.

It needs to be noted that when the distraction motor 44 rotates, it drives the rotating shaft 41 and the rotational gear 42 to rotate; under the action of the toothed belt 43, the two rotational gears 42 rotate synchronously, thereby driving a plurality of contact columns 45 to move outwards successively; at that, two sides of the inner layer and outer layer of the curtain cloth abutting against the contact column 45 have one outward pulling force, thereby enabling the inner layer and outer layer of the curtain cloth to spread outwards, avoiding the occurrence of a skew folding phenomenon caused by dry air blowing, and improving the subsequent bonding quality.

It further needs to be noted that a plurality of contact columns 45 is fixed at equal intervals on the outer side of the toothed belt 43; at the same time, the contact columns 45 are made of a rubber material; the contact columns 45 are in contact with the inner layer and outer layer of the curtain cloth so as to be able to contact at multiple points and faces; compared with the whole face contact on the outer side of the toothed belt 43, it can not only play the function of pulling the inner layer and outer layer of the curtain outwards, but also do not affect the normal movement and transportation.

The remaining structures are the same as those of embodiment 1.

Embodiment 3

With reference to FIG. 11, the implementation mode further explains other embodiments. In the figure, an inclined plate 46 is fixed to the outer side of one of the fixing plates 40, and a driven gear 47 is rotatably mounted to the tail end of the inclined plate 46; a driving gear 48 meshing with the driven gear 47 is fixed to the outer end of one of the rotating shafts 41, and a distraction wheel 49 in contact with the shading layer C is fixed to the outer side of the driven gear 47; the distraction wheel 49 is made of a rubber material.

It needs to be noted that with the operation of the distraction motor 44, the rotational gear 42 is driven to rotate, so that the rotating shaft 41 and the driving gear 48 rotate, and the driven gear 47 also follows the rotation; at that, the distraction wheel 49 rotates, and the two sides of the shading layer C are driven to have an outward pulling force; therefore, the shading layer C can be spread outward, avoiding the occurrence of a skew folding phenomenon caused by dry air blowing, and improving the subsequent bonding quality.

The present application is not limited to the specific implementation modes mentioned above. Various changes made by technical personnel in the technical field based on the above concept without creative labor fall within the scope of protection of the present application.

What is claimed is:

1. A manufacturing method for a light-colored full-shading curtain cloth, comprising steps:

weaving a first greige cloth of a curtain cloth by a weaving machine, and weaving a shading material into a second greige cloth of a shading layer by the weaving machine;

obtaining a curtain cloth outer layer and a curtain cloth inner layer of a first preset size by cutting the first greige cloth, and obtaining the shading layer of a second preset size by cutting the second greige cloth cleaning a cloth material, and placing the curtain cloth outer layer, the curtain cloth inner layer, and the shading layer into water for immersion cleaning for removing impurities attached on an outer side;

drying and rolling the cloth material, respectively placing cleaned curtain cloth outer layer, curtain cloth inner layer, and shading layer into a drying device for drying, and respectively rolling dried curtain cloth outer layer, curtain cloth inner layer, and shading layer;

transferring and secondary drying the cloth material, performing contacting transfer on the curtain cloth outer layer and the curtain cloth inner layer by using a pre-mounted turning component, and performing secondary drying on the curtain cloth outer layer and the curtain cloth inner layer by using a secondary drying mechanism built in the turning component, wherein the secondary drying mechanism comprises a drive rod and a docking frame in contact with the shading layer; two ends of the drive rod are rotatably docked with the two side plates, and a rotational motor for rotating the drive rod is fixed on the outer side of one of the side plates; two cylinders are rotatably mounted to the outer side of the drive rod, one end of the two cylinders is fixedly in communication with an air suction pipe, and the other end of the two cylinders is fixed with an exhaust pipe in communication with the docking frame; a plurality of air suction holes is opened on the outer side of the air suction pipe, an exhaust fan for air suction of the air suction pipe is fixed on an outer wall of the cylinder, the exhaust fan is located in the cylinder, and a mounting pipe fixed with the side plate is fixed on the outer side of the cylinder; a connecting column fixed to the side plate is fixed to two ends of the docking frame, an exhaust port is provided at a bottom of the docking frame, and a heating strip is fixed in the docking frame;

bonding between a plurality of layers of cloth materials, comprising applying glue to a gap at an outer edge of the curtain cloth outer layer and the curtain cloth inner layer for bonding the curtain cloth outer layer, the curtain cloth inner layer, and a middle shading layer;

performing rolling on the curtain cloth outer layer, the shading layer, and the curtain cloth inner layer bonded together; and painting a coating layer on an outer side of the curtain cloth outer layer.

2. The manufacturing method for a light-colored full-shading curtain cloth of claim 1, wherein the turning component comprises two turning rolls and two side plates, the two turning rolls are of a hollow pipe structure and are respectively in contact with the curtain cloth outer layer and the curtain cloth inner layer, two ends of the two turning rolls are fixedly in communication with a connecting pipe, and the connecting pipe is rotatably connected to the side plates; a plurality of rows of air blowing openings is provided at equal angles on an outer side of the turning rolls, and an occluding assembly is correspondingly mounted in each row of air blowing openings; one of the side plates is mounted with a drive member for rotating the turning roll, and the other side plate is mounted with an adjustment member for adjusting a form of the occluding assembly; an outer end of the connecting pipe is rotatably butted with an air transferring pipe for inflating dry hot air, and the secondary drying mechanism is mounted between the two side plates.

3. The manufacturing method for a light-colored full-shading curtain cloth of claim 2, wherein the occluding assembly comprises an adjustment lever and a plurality of occluding protrusions, tops of the occluding protrusions and the air blowing openings are inserted into each other, an adjustment seat is fixed at a bottom, an adjustment opening is opened in the adjustment seat, and a cross-sectional shape of the adjustment opening is a right-angled trapezoid; two ends of the adjustment lever slide through two ends of the turning roll and are inserted into the adjustment openings in one row of the adjustment seats, an adjustment inclined block adapted to a bevel end of the adjustment opening is fixed on the outer side of the adjustment lever, and a slide bar fixed to an inner wall of the turning roll is fixed on the outer side of the occluding protrusions.

4. The manufacturing method for a light-colored full-shading curtain cloth of claim 2, wherein the adjustment member comprises a hemispherical block fixed at the outer ends of the plurality of adjustment levers and an adjustment disk fixed at the outer side of one of the side plates; the adjustment disk is rotatably sleeved with one of the connecting pipes, an arc-shaped protrusion is fixed at the bottom of one side of the adjustment disk near the turning roll, the arc-shaped protrusion is fitted with the hemispherical block, and the outer sides of the plurality of adjustment levers are all sleeved with an extrusion spring abutting against the hemispherical block and an outer wall of the turning roll.

5. The manufacturing method for a light-colored full-shading curtain cloth of claim 4, wherein the outer side of the adjustment lever is sleeved with a grommet abutting against the extrusion spring.

6. The manufacturing method for a light-colored full-shading curtain cloth of claim 2, wherein the drive member comprises a drive motor fixed to the side plate; an output end of the drive motor is fixed with a drive gear, and the outer side of the connecting pipe is fixed with a transmission gear that meshes with the drive gear.

7. The manufacturing method for a light-colored full-shading curtain cloth of claim 1, wherein two secondary drying mechanisms are provided, and the two secondary drying mechanisms are distributed on two sides of the shading layer.

8. The manufacturing method for a light-colored full-shading curtain cloth of claim 7, wherein two air suction pipes are provided and are respectively located on the outer side of the turning roll.

9. The manufacturing method for a light-colored full-shading curtain cloth of claim 2, wherein two contact rolls are fixed between the two side plates, and the two contact rolls are distributed on the outer side of the two docking frames for contacting the shading layer.

10. The manufacturing method for a light-colored full-shading curtain cloth of claim 2, wherein two support plates are provided at front ends of the two side plates, and two groups of guide posts are fixed between the two support plates; the two groups of guide posts are symmetrically distributed on two sides of the shading layer, and are in contact with the curtain cloth outer layer and the curtain cloth inner layer; each group of guide posts is composed of two guide posts, and the shading layer is successively fitted with the outer sides of the two guide posts.

11. The manufacturing method for a light-colored full-shading curtain cloth of claim 10, wherein four distraction pieces are fixed between the two support plates and symmetrically distributed on two sides of the shading layer, each distraction piece comprises two fixing plates and two rotating shafts rotatably mounted between the two fixing plates, a rotational gear is fixed on the outer side of the two rotating shafts, and the outer sides of the two rotational gears are meshed and sleeved with a toothed belt; a distraction motor is fixed on the outer side of one of the fixing plates, and an output end of the distraction motor is fixed with one end of the rotating shaft.

12. The manufacturing method for a light-colored full-shading curtain cloth of claim 11, wherein the outer side of the toothed belt is fixedly provided with a plurality of contact columns at equal intervals.

13. The manufacturing method for a light-colored full-shading curtain cloth of claim 12, wherein an inclined plate is fixed to the outer side of one of the fixing plates, and a driven gear is rotatably mounted to a tail end of the inclined plate; a driving gear meshing with the driven gear is fixed to the outer end of one of the rotating shafts, and a distraction wheel in contact with the shading layer is fixed to the outer side of the driven gear.

14. The manufacturing method for a light-colored full-shading curtain cloth of claim 13, wherein the contact column and the distraction wheel are both made of rubber material.

* * * * *